US006450768B2

(12) United States Patent
Mashey

(10) Patent No.: US 6,450,768 B2
(45) Date of Patent: Sep. 17, 2002

(54) AXIAL THERMAL MEDIUM DELIVERY TUBES AND RETENTION PLATES FOR A GAS TURBINE ROTOR

(75) Inventor: Thomas Charles Mashey, Coxsackie, NY (US)

(73) Assignee: General Electric Company, Schenectady, NY (US)

( * ) Notice: Subject to any disclaimer, the term of this patent is extended or adjusted under 35 U.S.C. 154(b) by 71 days.

(21) Appl. No.: 09/778,042

(22) Filed: Feb. 7, 2001

Related U.S. Application Data

(63) Continuation of application No. 09/334,187, filed on Jun. 16, 1999, now abandoned.

(51) Int. Cl.[7] ..... F01D 5/08

(52) U.S. Cl. ..... 416/96 R; 415/115; 415/116

(58) Field of Search ..... 415/114, 115, 415/116; 416/96 R, 95, 96 A, 97 R; 285/41, 121.6, 127.1

(56) References Cited

U.S. PATENT DOCUMENTS

| | | | | |
|---|---|---|---|---|
| 4,364,241 | A | 12/1982 | Okamoto et al. | 62/505 |
| 5,593,274 | A | 1/1997 | Carreno et al. | 415/115 |
| 5,984,637 | A | 11/1999 | Matsuo | 416/97 R |
| 6,007,299 | A | 12/1999 | Uematsu | 416/96 R |

OTHER PUBLICATIONS

"39$^{th}$ GE Turbine State–of–the–Art Technology Seminar", Tab 1, ""F" Technology—the First Half–Million Operating Hours", H.E. Miller, Aug. 1996.

"39th GE Turbine State–of–the–Art Technology Seminar", Tab 2, "GE Heavy–Duty Gas Turbine Performance Characteristics", F. J. Brooks, Aug. 1996.

"39th GE Turbine State–of–the–Art Technology Seminar", Tab 3, "9EC 50Hz 170–MW Class Gas Turbine", A. S. Arrao, Aug. 1996.

"39th GE Turbine State–of–the–Art Technology Seminar", Tab 4, "MWS6001FA—An Advanced–Technology 70–MW Class 50/60 Hz Gas Turbine", Ramachandran et al., Aug. 1996.

"39th GE Turbine State–of–the–Art Technology Seminar", Tab 5, "Turbomachinery Technology Advances at Nuovo Pignone", Benvenuti et al., Aug. 1996.

"39th GE Turbine State–of–the–Art Technology Seminar", Tab 6, "GE Aeroderivative Gas Turbines—Design and Operating Features", M.W. Horner, Aug. 1996.

"39th GE Turbine State–of–the–Art Technology Seminar", Tab 7, "Advance Gas Turbine Materials and Coatings", P.W. Schilke, Aug. 1996.

"39th GE Turbine State–of–the–Art Technology Seminar", Tab 8, "Dry Low $NO_x$ Combustion Systems for GE Heavy–Duty Turbines", L. B. Davis, Aug. 1996.

(List continued on next page.)

*Primary Examiner*—Edward K. Look
*Assistant Examiner*—Richard A. Edgar
(74) *Attorney, Agent, or Firm*—Nixon & Vanderhye

(57) ABSTRACT

In a multi-stage turbine rotor, tubes are disposed in openings adjacent the rotor rim for flowing a thermal medium to rotor buckets and returning spent thermal medium. The tubes have axially spaced lands of predetermined wall thickness with thin-walled tube sections between the lands and of increasing thickness from the forward to the aft ends of the tubes. A pair of retention plates are carried on the aft end face of the aft wheel and straddle the tube and engage against a shoulder on the tube to preclude displacement of the tube in an aft direction.

18 Claims, 9 Drawing Sheets

OTHER PUBLICATIONS

"39th GE Turbine State–of–the–Art Technology Seminar", Tab 9, "GE Gas Turbine Combustion Flexibility", M. A. Davi, Aug. 1996.
"39th GE Turbine State–of–the–Art Technology Seminar", Tab 10, "Gas Fuel Clean–Up System Design Considerations for GE Heavy–Duty Gas Turbines", C. Wilkes, Aug. 1996.
"39th GE Turbine State–of–the–Art Technology Seminar", Tab 11, "Integrated Control Systems for Advanced Combined Cycles", Chu et al., Aug. 1996.
"39th GE Turbine State–of–the–Art Technology Seminar", Tab 12, "Power Systems for the 21st Century "H" Gas Turbine Combined Cycles", Paul et al., Aug. 1996.
"39th GE Turbines State–of–the–Art Technology Seminar", Tab 13, "Clean Coal and Heavy Oil Technologies for Gas Turbines", D. M. Todd, Aug. 1996.
"39th GE Turbine State–of–the–Art Technology Seminar", Tab 14, "Gas Turbine Conversions, Modifications and Uprates Technology", Stuck et al., Aug. 1996.
"39th GE Turbine State–of–the–Art Technology Seminar", Tab 15, "Performance and Reliability Improvements for Heavy–Duty Gas Turbines,"J.R. Johnston, Aug. 1996.
"39th GE Turbine State–of–the–Art Technology Seminar", Tab 16, "Gas Turbine Repair Technology", Crimi et al, Aug. 1996.
"39th GE Turbine State–of–the–Art Technology Seminar", Tab 17, "Heavy Duty Turbine Operating & Maintenance Considerations", R. F. Hoeft, Aug. 1996.
"39th GE Turbine State–of–the–Art Technology Seminar", Tab 18, "Gas Turbine Performance Monitoring and Testing", Schmitt et al., Aug. 1996.
"39th GE Turbine State–of–the–Art Technology Seminar", Tab 19, "Monitoring Service Delivery System and Diagnostics", Madej et al., Aug. 1996.
"39th GE Turbine State–of–the–Art Technology Seminar", Tab 20, "Steam Turbines for Large Power Applications", Reinker et al., Aug. 1996.
"39th GE Turbine State–of–the–Art Technology Seminar", Tab 21, "Steam Turbines for Ultrasupercritical Power Plants", Retzlaff et al., Aug. 1996.
"39th GE Turbine State–of–the–Art Technology Seminar", Tab 22, "Steam Turbines Sustained Efficiency", P. Schofield, Aug. 1996.
"39th GE Turbine State–of–the–Art Technology Seminar", Tab 23, "Recent Advances in Steam Turbines for Industrial and Cogeneration Applications", Leger et al., Aug. 1996.
"39th GE Turbine State–of–the–Art Technology Seminar", Tab 24, "Mechanical Drive Steam Turbines", D. R. Leger, Aug. 1996.
"39th GE Turbine State–of–the–Art Technology Seminar", Tab 25, "Steam Turbines for STAG™ Combined–Cycle Power Systems", M. Boss, Aug. 1996.
"39th GE Turbine State–of–the–Art Technology Seminar", Tab 26, "Cogeneration Application Considerations", Fisk et al., Aug. 1996.
"39th GE Turbine State–of–the–Art Technology Seminar", Tab 27, "Performance and Economic Considerations of Repowering Steam Power Plants", Stoll et al., Aug. 1996.
"39th GE Turbine State–of–the–Art Technology Seminar", Tab 28, "High–Power–Density™ Steam Turbine Design Evolution", J. H. Moore, Aug. 1996.
"39th GE Turbine State–of–the–Art Technology Seminar", Tab 29, "Advances in Steam Path Technologies", Cofer, IV, et al., Aug. 1996.
"39th GE Turbine State–of–the–Art Technology Seminar", Tab 30, "Upgradable Opportunities for Steam Turbines", D. R. Dreier, Jr., Aug. 1996.
"39th GE Turbine State–of–the–Art Technology Seminar", Tab 31, "Uprate Options for Industrial Turbines", R. C. Beck, Aug. 1996.
"39th GE Turbine State–of–the–Art Technology Seminar", Tab 32, "Thermal Performance Evaluation and Assessment of Steam Turbine Units", P. Albert, Aug. 1996.
"39th GE Turbine State–of–the–Art Technology Seminar", Tab 33, "Advances in Welding Repair Technology" J. F. Nolan, Aug. 1996.
"39th GE Turbine State–of–the–Art Technology Seminar", Tab 34, "Operation and Maintenance Strategies to Enhance Plant Profitability", MacGillivray et al., Aug. 1996.
"39th GE Turbine State–of–the–Art Technology Seminar", Tab 35, "Generator Insitu Inspections", D. Stanton.
"39th GE Turbine State–of–the–Art Technology Seminar", Tab 36, "Generator Upgrade and Rewind", Halpern et al., Aug. 1996.
"39th GE Turbine State–of–the–Art Technology Seminar", Tab 37, "GE Combined Cycle Product Line and Performance", Chase, et al., Aug. 1996.
"39th GE Turbine State–of–the–Art Technology Seminar", Tab 38, "GE Combined Cycle Experience", Maslak et al., Aug. 1996.
"39th GE Turbine State–of–the–Art Technology Seminar", Tab 39, "Single–Shaft Combined Cycle Power Generation Systems", Tomlinson et al., Aug. 1996.
"Advanced Turbine System Program—Conceptual Design and Product Development", Annual Report, Sep. 1, 1994–Aug. 31, 1995.
"Advanced Turbine Systems (ATS Program) Conceptual Design and Product Development", Final Technical Progress Report, vol. 2—Industrial Machine, Mar. 31, 1997, Morgantown, WV.
"Advanced Turbine Systems (ATS Program), Conceptual Design and Product Development", Final Technical Progress Report, Aug. 31, 1996, Morgantown, WV.
"Advanced Turbine Systems (ATS) Program, Phase 2, Conceptual Design and Product Development", Yearly Technical Progress Report, Reporting Period: Aug. 25, 1993–Aug. 31, 1994.
"Advanced Turbine Systems" Annual Program Review, Preprints, Nov. 2–4, 1998, Washington, D.C. U.S. Department of Energy, Office of Industrial Technologies Federal Energy Technology Center.
"ATS Conference" Oct. 28, 1999, Slide Presentation.
"Baglan Bay Launch Site", various articles relating to Baglan Energy Park.
"Baglan Energy Park", Brochure.
"Commercialization", Del Williamson, Present, Global Sales, May 8, 1998.
"Environmental, Health and Safety Assessment: ATS 7H Program (Phase 3R) Test Activities at the GE Power Systems Gas Turbine Manufacturing Facility, Greenville, SC", Document #1753, Feb. 1998, Publication Date: Nov. 17, 1998, Report Nos. DE–FC21–95MC31176–11.
"Exhibit panels used at 1995 product introduction at PowerGen Europe".
"Extensive Testing Program Validates High Efficiency, reliability of GE's Advanced "H" Gas Turbine Technology", Press Information, Press Release, 96–NR14, Jun. 26, 1996, H Technology Tests/pp. 1–4.

"Extensive Testing Program Validates High Efficiency, Reliability of GE's Advanced "H" Gas Turbine Technology", GE Introduces Advanced Gas Turbine Technology Platform: First to Reach 60% Combined–Cycle Power Plant Efficiency, Press Information, Press Release, Power–Gen Europe '95, 95–NRR15, Advanced Technology Introduction/pp. 1–6.

"Gas, Steam Turbine Work as Single Unit in GE's Advanced H Technology Combined–Cycle System", Press Information, Press Release, 95–NR18, May 16, 1995, Advanced Technology Introduction/pp. 1–3.

"GE Breaks 60% Net Efficiency Barrier" paper, 4 pages.

"GE Business Share Technologies and Experts to Develop State–Of–The–Art Products", Press Information, Press Release 95–NR10, May 16, 1995, GE Technology Transfer/pp. 1–3.

"General Electric ATS Program Technical Review, Phase 2 Activities", T. Chance et al., pp. 1–4.

"General Electric's DOE/ATS H Gas Turbine Development" Advanced Turbine Systems Annual Review Meeting, Nov. 7–8, 1996, Washington, D.C., Publication Release.

"H Technology Commercialization", 1998 MarComm Activity Recommendation, Mar., 1998.

"H Technology", Jon Ebacher, VP, Power Gen Technology, May 8, 1998.

"H Testing Process", Jon Ebacher, VP, Power Gen Technology, May 8, 1998.

"Heavy–Duty & Aeroderivative Products" Gas Turbines, Brochure, 1998.

"MS7001H/MS9001H Gas Turbine, gepower.com website for PowerGen Europe" Jun. 1–3 going public Jun. 15, (1995).

"New Steam Cooling System is a Key to 60% Efficiency For GE "H" Technology Combined–Cycle Systems", Press Information, Press Release, 95–NRR15, May 16, 1995, H Technology/pp. 1–3.

"Overview of GE's H Gas Turbine Combined Cycle", Jul. 1, 1995 to Dec. 31, 1997.

"Power Systems for the 21$^{st}$ Century—"H" Gas Turbine Combined Cycles", Thomas C. Paul et al., Report.

"Power–Gen '96 Europe", Conference Programme, Budapest, Hungary, Jun. 26–28, 1996.

"Power–Gen International", 1998 Show Guide, Dec. 9–11, 1998, Orange County Convention Center, Orlando, Florida.

"Press Coverage following 1995 product announcement"; various newspaper clippings relating to improved generator.

"Proceedings of the Advanced Turbine Systems Annual Program Review Meeting", vol. I, "Industrial Advanced Turbine Systems Program Overview", D.W. Esbeck, p. 3–13, Oct., 1995.

"Proceedings of the Advanced Turbine Systems Annual Program Review Meeting", vol. I, "H Gas Turbine Combined Cycle", J. Corman, p. 14–21, Oct., 1995.

"Proceedings of the Advanced Turbine Systems Annual Program Review Meeting", vol. I, "Overview of Westinghouse's Advanced Turbine Systems Program", Bannister et al., p. 22–30, Oct., 1995.

"Proceedings of the Advanced Turbine Systems Annual Program Review Meeting", vol. I, "Allison Engine ATS Program Technical Review", D. Mukavetz, p. 31–42, Oct., 1995.

"Proceedings of the Advanced Turbine Systems Annual Program Review Meeting", vol. I, "Advanced Turbine Systems Program Industrial System Concept Development", S. Gates, p. 43–63, Oct., 1995.

"Proceedings of the Advanced Turbine Systems Annual Program Review Meeting", vol. I, "Advanced Turbine System Program Phase 2 Cycle Selection", Latcovich, Jr., p. 64–69, Oct., 1995.

"Proceedings of the Advanced Turbine Systems Annual Program Review Meeting", vol. I, "General Electric ATS Program Technical Review Phase 2 Activities", Chance et al., p. 70–74, Oct., 1995.

"Proceedings of the Advanced Turbine Systems Annual Program Review Meeting", vol. I, "Technical Review of Westinghouse's Advanced Turbine Systems Program", Diakunchak et al., p. 75–86, Oct., 1995.

"Proceedings of the Advanced Turbine Systems Annual Program Review Meeting", vol. I, "Advanced Combustion Turbines and Cycles: An EPRI Perspective", Touchton et al., p. 87–88, Oct., 1995.

"Proceedings of the Advanced Turbine Systems Annual Program Review Meeting", vol. I, "Advanced Turbine Systems Annual Program Review", William E. Koop, p. 89–92, Oct., 1995.

"Proceedings of the Advanced Turbine Systems Annual Program Review Meeting", vol. I, "The AGTSR Consortium: An Update", Fant et al., p. 93–102, Oct., 1995.

"Proceedings of the Advanced Turbine Systems Annual Program Review Meeting", vol. I, "Overview of Allison/AGTSR Interactions", Sy A. Ali, p. 103–106, Oct., 1995.

"Proceedings of the Advanced Turbine Systems Annual Program Review Meeting", vol. I, "Design Factors for Stable Lean Premix Combustion", Richards et al., p. 107–113, Oct., 1995.

"Proceedings of the Advanced Turbine Systems Annual Program Review Meeting", vol. I, "Ceramic Stationary as Turbine", M. van Roode, p. 114–147, Oct., 1995.

"Proceedings of the Advanced Turbine Systems Annual Program Review Meeting", vol. I, "DOE/Allison Ceramic Vane Effort", Wenglarz et al., p. 148–151, Oct., 1995.

"Proceedings of the Advanced Turbine Systems Annual Program Review Meeting", vol. I, "Materials/Manufacturing Element of the Advanced Turbine Systems Program", Karnitz et al., p. 152–160, Oct., 1995.

"Proceedings of the Advanced Turbine Systems Annual Program Review Meeting", vol. I, "Land–Based Turbine Casting Initiative", Mueller et al., p. 161–170, Oct., 1995.

"Proceedings of the Advanced Turbine Systems Annual Program Review Meeting", vol. I, "Turbine Airfoil Manufacturing Technology", Kortovich, p. 171–181, Oct., 1995.

"Proceedings of the Advanced Turbine Systems Annual Program Review Meeting", vol. I, "Pratt & Whitney Thermal Barrier Coatings", Bornstein et al., p. 182–193, Oct., 1995.

"Proceedings of the Advanced Turbine Systems Annual Program Review Meeting", vol. I, "Westinhouse Thermal Barrier Coatings", Goedjen et al., p. 194–199, Oct., 1995.

"Proceedings of the Advanced Turbine Systems Annual Program Review Meeting", vol. I, "High Performance Steam Development", Duffy et al., p. 200–220, Oct., 1995.

"Proceedings of the Advanced Turbine Systems Annual Program Review Meeting", vol. II, "Lean Premixed Combustion Stabilized by Radiation Feedback and heterogeneous Catalysis", Dibble et al., p. 221–232, Oct., 1995.

"Proceedings of the Advanced Turbine Systems Annual Program Review Meeting", vol. II, Rayleigh/Raman/LIF Measurements in a Turbulent Lean Premixed Combustor, Nandula et al., p. 233–248, Oct., 1995.

"Proceedings of the Advanced Turbine Systems Annual Program Review Meeting", vol. II, "Lean Premixed Flames for Low $No_x$ Combustors", Sojka et al., p. 249–275, Oct., 1995.

"Proceedings of the Advanced Turbine Systems Annual Program Review Meeting", vol. II, "Functionally Gradient Materials for Thermal Barrier Coatings in Advanced Gas Turbine Systems", Banovic et al., p. 276–280, Oct., 1995.

"Proceedings of the Advanced Turbine Systems Annual Program Review Meeting", vol. II, "Advanced Turbine Cooling, Heat Transfer, and Aerodynamic Studies", Han et al., p. 281–309, Oct., 1995.

"Proceedings of the Advanced Turbine Systems Annual Program Review Meeting", vol. II, "Life Prediction of Advanced Materials for Gas Turbine Application", Zamrik et al., p. 310–327, Oct., 1995.

"Proceedings of the Advanced Turbine Systems Annual Program Review Meeting", vol. II, "Advanced Combustion Technologies for Gas Turbine Power Plants", Vandsburger et al., p. 328–352, Oct., 1995.

"Proceedings of the Advanced Turbine Systems Annual Program Review Meeting", vol. II, "Combustion Modeling in Advanced Gas Turbine Systems", Smoot et al., p. 353–370, Oct., 1995.

"Proceedings of the Advanced Turbine Systems Annual Program Review Meeting", vol. II, "Heat Transfer in a Two–Pass Internally Ribbed Turbine Blade Coolant Channel with Cylindrical Vortex Generators", Hibbs et al. pp. 371–390, Oct., 1995.

"Proceedings of the Advanced Turbine Systems Annual Program Review Meeting", vol. II, "Rotational Effects on Turbine Blade Cooling", Govatzidakia et al., p. 391–392, Oct., 1995.

"Proceedings of the Advanced Turbine Systems Annual Program Review Meeting", vol. II, "Manifold Methods for Methane Combustion", Yang et al., p. 393–409, Oct., 1995.

"Proceedings of the Advanced Turbine Systems Annual Program Review Meeting", vol. II, "Advanced Multistage Turbine Blade Aerodynamics, Performance, Cooling, and Heat Transfer", Fleeter et al., p. 410–414, Oct., 1995.

"Proceedings of the Advanced Turbine Systems Annual Program Review Meeting, Volume II", The Role of Reactant Unmixedness, Strain Rate, and Length Scale on Premixed Combustor Performance, Samuelsen et al., p. 415–422, Oct., 1995.

"Proceedings of the Advanced Turbine Systems Annual Program Review Meeting", vol. II, "Experimental and Computational Studies on Film Cooling With Compound Angle Injection", Goldstein et al., p. 423–451, Oct., 1995.

"Proceedings of the Advanced Turbine Systems Annual Program Review Meeting", vol. II, "Compatibility of Gas Turbine Materials with Steam Cooling", Desai et al., p. 452–464, Oct., 1995.

"Proceedings of the Advanced Turbine Systems Annual Program Review Meeting", vol. II, "Use of a Laser–Induced Fluorescence Thermal Imaging System for Film Cooling Heat Transfer Measurement", M. K. Chyu, p. 465–473, Oct., 1995.

"Proceedings of the Advanced Turbine Systems Annual Program Review Meeting", vol. II, Effects of Geometry on Slot–Jet Film Cooling Performance, Hyams et al., p. 474–496 Oct., 1995.

"Proceedings of the Advanced Turbine Systems Annual Program Review Meeting", vol. II, "Steam as Turbine Blade Coolant: Experimental Data Generation", Wilmsen et al., p. 497–505, Oct., 1995.

"Proceedings of the Advanced Turbine Systems Annual Program Review Meeting", vol. II, "Combustion Chemical Vapor Deposited Coatings for Thermal Barrier Coating Systems", Hampikian et al., p. 506–515, Oct., 1995.

"Proceedings of the Advanced Turbine Systems Annual Program Review Meeting", vol. I, "Premixed Burner Experiments: Geometry, Mixing, and Flame Structure Issues", Gupta et al., p. 516–528, Oct., 1995.

"Proceedings of the Advanced Turbine Systems Annual Program Review Meeting", vol. II, "Intercooler Flow Path for Gas Turbines: CFD Design and Experiments", Agrawal et al., p. 529–538, Oct., 1995.

"Proceedings of the Advanced Turbine Systems Annual Program Review Meeting", vol. II, "Bond Strength and Stress Measurements in Thermal Barrier Coatings", Gell et al., p. 539–549, Oct., 1995.

"Proceedings of the Advanced Turbine Systems Annual Program Review Meeting", vol. II, "Active Control of Combustion Instabilities in Low $NO_x$ Gas Turbines", Zinn et al., p. 550–551, Oct., 1995.

"Proceedings of the Advanced Turbine Systems Annual Program Review Meeting", vol. II, "Combustion Instability Modeling and Analysis", Santoro et al., p. 552–559, Oct., 1995.

"Proceedings of the Advanced Turbine Systems Annual Program Review Meeting", vol. II, "Flow and Heat Transfer in Gas Turbine Disk Cavities Subject to Nonuniform External Pressure Field", Roy et al., p. 560–565, Oct., 1995.

"Proceedings of the Advanced Turbine Systems Annual Program Review Meeting", vol. II, "Heat Pipe Turbine Vane Cooling", Langston et al., p. 566–572, Oct., 1995.

"Proceedings of the Advanced Turbine Systems Annual Program Review Meeting", vol. II, "Improved Modeling Techniques for Turbomachinery Flow Fields", Lakshminarayana et al., p. 573–581, Oct., 1995.

"Proceedings of the Advanced Turbine Systems Annual Program Review Meeting", vol. II, "Advanced 3D Inverse Method for Designing Turbomachine Blades", T. Dang, p. 582, Oct., 1995.

"Proceedings of the Advanced Turbine Systems Annual Program Review Meeting", "ATS and the Industries of the Future", Denise Swink, p. 1, Nov., 1996.

"Proceedings of the Advanced Turbine Systems Annual Program Review Meeting", "Gas Turbine Association Agenda", William H. Day, p. 3–16, Nov., 1996.

"Proceedings of the Advanced Turbine Systems Annual Program Review Meeting", "Power Needs in the Chemical Industry", Keith Davidson, p. 17–26, Nov., 1996.

"Proceedings of the Advanced Turbine Systems Annual Program Review Meeting", "Advanced Turbine Systems Program Overview", David Esbeck, p. 27–34, Nov., 1996.

"Proceedings of the Advanced Turbine Systems Annual Program Review Meeting", "Westinghouse's Advanced Turbine Systems Program", Gerard McQuiggan, p. 35–48, Nov., 1996.

"Proceedings of the Advanced Turbine Systems Annual Program Review Meeting", "Overview of GE's H Gas Turbine Combined Cycle", Cook et al., p. 49–72, Nov., 1996.
"Proceedings of the Advanced Turbine Systems Annual Program Review Meeting", "Allison Advanced Simple Cycle Gas Turbine System", William D. Weisbrod, p. 73–94, Nov., 1996.
"Proceedings of the Advanced Turbine Systems Annual Program Review Meeting", "The AGTSR Industry–University Consortium", Lawrence P. Golan, p. 95–110, Nov., 1996.
"Proceedings of the Advanced Turbine Systems Annual Program Review Meeting", "$NO_x$ and CO Emissions Models for Gas–Fired Lean–Premixed Combustion Turbines", A. Mellor, p. 111–122, Nov., 1996.
"Proceedings of the Advanced Turbine Systems Annual Program Review Meeting", "Methodologies for Active Mixing and Combustion Control", Uri Vandsburger, p. 123–156, Nov., 1996.
"Proceedings of the Advanced Turbine Systems Annual Program Review Meeting", "Combustion Modeling in Advanced Gas Turbine Systems", Paul O. Hedman, p. 157–180, Nov., 19967.
"Proceedings of the Advanced Turbine Systems Annual Program Review Meeting", "Manifold Methods for Methane Combustion", Stephen B. Pope, p. 181–188, Nov., 1996.
"Proceedings of the Advanced Turbine Systems Annual Program Review Meeting", "The Role of Reactant Unmixedness, Strain Rate, and Length Scale on Premixed Combustor Performance", Scott Samuelsen, p. 189–210, Nov., 1996.
"Proceedings of the Advanced Turbine Systems Annual Program Review Meeting", "Effect of Swirl and Momentum Distribution on Temperature Distribution in Premixed Flames", Ashwani K. Gupta, p. 211–232, Nov., 1996.
"Proceedings of the Advanced Turbine Systems Annual Program Review Meeting", "Combustion Instability Studies Application to Land–Based Gas Turbine Combustors", Robert J. Santoro, p. 233–252.
"Proceedings of the Advanced Turbine Systems Annual Program Review Meeting", Active Control of Combustion Instabilities in Low $NO_x$ Turbines, Ben T. Zinn, p. 253–264, Nov., 1996.
"Proceedings of the Advanced Turbine Systems Annual Program Review Meeting", "Life Prediction of Advanced Materials for Gas Turbine Application" Sam Y. Zamrik, p. 265–274, Nov., 1996.
"Proceedings of the Advanced Turbine Systems Annual Program Review Meeting", "Combustion Chemical Vapor Deposited Coatings for Thermal Barrier Coating Systems", W. Brent Carter, p. 275–290, Nov., 1996.
"Proceedings of the Advanced Turbine Systems Annual Program Review Meeting", "Compatibility of Gas Turbine Materials with Steam Cooling", Vimal Desai, p. 291–314, Nov., 1996.
"Proceedings of the Advanced Turbine Systems Annual Program Review Meeting", "Bond Strength and Stress Measurements in Thermal Barrier Coatings", Maurice Gell, p. 315–334, Nov., 1996.
"Proceedings of the Advanced Turbine Systems Annual Program Review Meeting", "Advanced Multistage Turbine Blade Aerodynamics, Performance, Cooling and Heat Transfer", Sanford Fleeter, p. 335–356, Nov., 1996.
"Proceedings of the Advanced Turbine Systems Annual Program Review Meeting", "Flow Characteristics of an Intercooler System for Power Generating Gas Turbines", Ajay K. Agrawal, p. 357–370, Nov., 1996.
"Proceedings of the Advanced Turbine Systems Annual Program Review Meeting", "Improved Modeling Techniques for Turbomachinery Flow Fields", B. Lakshiminarayana, p. 371–392, Nov., 1996.
"Proceedings of the Advanced Turbine Systems Annual Program Review Meeting", "Development of an Advanced 3d & Viscous Aerodynamics Design Method for Turbomachine Components in Utility and Industrial Gas Turbine Applications", Thong Q. Dang, p. 393–406, Nov., 1996.
"Proceedings of the Advanced Turbine Systems Annual Program Review Meeting", "Advanced Turbine Cooling, Heat Transfer, and Aerodynamic Studies", Je–Chin Han, p. 407–426, Nov., 1996.
"Proceedings of the Advanced Turbine Systems Annual Program Review Meeting", "Heat Transfer in a Two–Pass Internally Ribbed Turbine Blade Coolant Channel with Vortex Generators", S. Acharya, p. 427–446.
"Proceedings of the Advanced Turbine Systems Annual Program Review Meeting", "Experimental and Computational Studies of Film Cooling with Compound Angle Injection", R. Goldstein, p. 447–460, Nov., 1996.
"Proceedings of the Advanced Turbine Systems Annual Program Review Meeting", "Study of Endwall Film Cooling with a Gap Leakage Using a Thermographic Phospor Fluorescence Imaging System", Minking K. Chyu, p. 461–470, Nov., 1996.
"Proceedings of the Advanced Turbine Systems Annual Program Review Meeting", "Steam as a Turbine Blade Coolant: External Side Heat Transfer", Abraham Engeda, p. 471–482, Nov., 1996.
"Proceedings of the Advanced Turbine Systems Annual Program Review Meeting", "Flow and Heat Transfer in Gas Turbine Disk Cavities Subject to Nonuniform External Pressure Field", Ramendra Roy, p. 483–498, Nov., 1996.
"Proceedings of the Advanced Turbine Systems Annual Program Review Meeting", "Closed–Loop Mist/Steam Cooling for Advanced Turbine Systems", Ting Wang, p. 499–512, Nov., 1996.
"Proceedings of the Advanced Turbine Systems Annual Program Review Meeting", "Heat Pipe Turbine Vane Cooling", Langston et al., p. 513–534, Nov., 1996.
"Proceedings of the Advanced Turbine Systems Annual Program Review Meeting", "EPRI's Combustion Turbine Program: Status and Future Directions", Arthur Cohn, p. 535,–552, Nov., 1996.
"Proceedings of the Advanced Turbine Systems Annual Program Review Meeting", "ATS Materials Support", Michael Karnitz, p. 553–576, Nov., 1996.
"Proceedings of the Advanced Turbine Systems Annual Program Review Meeting", "Land Based Turbine Casting Initiative", Boyd A. Mueller, p. 577–592, Nov., 1996.
"Proceedings of the Advanced Turbine Systems Annual Program Review Meeting", "Turbine Airfoil Manufacturing Technology", Charles S. Kortovich, p. 593–622, Nov., 1996.
"Proceedings of the Advanced Turbine Systems Annual Program Review Meeting", "Hot Corrosion Testing of TBS's", Norman Bornstein, p. 623–631, Nov., 1996.
"Proceedings of the Advanced Turbine Systems Annual Program Review Meeting", "Ceramic Stationary Gas Turbine", Mark van Roode, p. 633–658, Nov., 1996.

"Proceedings of the Advanced Turbine Systems Annual Program Review Meeting", "Western European Status of Ceramics for Gas Turbines", Tibor Bornemisza, p. 659–670, Nov., 1996.

"Proceedings of the Advanced Turbine Systems Annual Program Review Meeting", "Status of Ceramic Gas Turbines in Russia", Mark van Roode, p. 671, Nov., 1996.

"Status Report: The U.S. Department of Energy's Advanced Turbine systems Program", facsimile dated Nov. 7, 1996.

"Testing Program Results Validate GE's H Gas Turbine—High Efficiency, Low Cost of Electricity and Low Emissions", Roger Schonewald and Patrick Marolda, (no date available).

"Testing Program Results Validate GE's H Gas Turbine—High Efficiency, Low Cost of Electricity and Low Emissions", Slide Presentation—working draft, (no date available).

"The Next Step In H . . . For Low Cost Per kW–Hour Power Generation", LP–1 PGE '98.

"Utility Advanced Turbine System (ATS) Technology Readiness Testing and Pre–Commercialization Demonstration", Document #486040, Oct. 1–Dec. 31, 1996, Publication Date, Jun. 1, 1997, Report Nos.: DOE/MC/31176–5628.

"Utility Advanced Turbine System (ATS) Technology Readiness Testing—Phase 3", Document #666274, Oct. 1, 1996–Sep. 30, 1997, Publication Date, Dec. 31, 1997, Report Nos.: DOE/MC/31176–10.

"Utility Advanced Turbine System (ATS) Technology Readiness Testing and Pre–Commercial Demonstration, Phase 3", Document #486029, Oct. 1–Dec. 31, 1995, Publication Date, May 1, 1997, Report Nos.: DOE/MC/31176–5340.

"Utility Advanced Turbine System (ATS) Technology Readiness Testing and Pre–Commercial Demonstration—Phase 3", Document #486132, Apr. 1–Jun. 30, 1976, Publication Date, Dec. 31, 1996, Report Nos.: DOE/MC/31176–5660.

"Utility Advanced Turbine System (ATS) Technology Readiness Testing and Pre–Commercial Demonstration—Phase 3", Document #587906, Jul. 1–Sep. 30, 1995, Publication Date, Dec. 31, 1995, Report Nos.: DOE/MC/31176–5339.

"Utility Advanced Turbine System (ATS) Technology Readiness Testing and Pre–Commercial Demonstration" Document #666277, Apr. 1–Jun. 30, 1997, Publication Date, Dec. 31, 1997, Report Nos.: DOE/MC/31176–8.

"Utility Advanced Turbine System (ATS) Technology Readiness Testing and Pre–Commercialization Demonstration" Jan. 1–Mar. 31, 1996, DOE/MC/31176–5338.

"Utility Advanced Turbine System (ATS) Technology Readiness Testing: Phase 3R", Document #756552, Apr. 1–Jun. 30, 1999, Publication Date, Sep. 1, 1999, Report Nos.: DE–FC21–95MC31176–23.

"Utility Advanced Turbine System (ATS) Technology Readiness Testing.", Document #656823, Jan. 1–Mar. 31, 1998, Publication Date, Aug. 1, 1998, Report Nos.: DOE/MC/31176–17.

"Utility Advanced Turbine Systems (ATS) Technology Readiness Testing and Pre–Commercial Demonstration", Annual Technical Progress Report, Reporting Period: Jul. 1, 1995–Sep. 30, 1996.

"Utility Advanced Turbine Systems (ATS) Technology Readiness Testing", Phase 3R, Annual Technical Progress Report, Reporting Period: Oct. 1, 1997–Sep. 30, 1998.

"Utility Advanced Turbine Systems (ATS) Technology Readiness Testing", Document #750405, Oct. 1–Dec. 30, 1998, Publication Date: May, 1, 1999, Report Nos.: DE–FC21–95MC31176–20.

"Utility Advanced Turbine Systems (ATS) Technology Readiness Testing", Document #1348, Apr. 1–Jun. 29, 1998, Publication Date Oct. 29, 1998, Report Nos. DE–FC21–95MC31176–18.

"Utility Advanced Turbine Systems (ATS) Technology Readiness Testing—Phase 3," Annual Technical Progress Report, Reporting Period: Oct. 1, 1996–Sep. 30, 1997.

"Utility Advanced Turbine Systems (ATS) Technology Readiness Testing and Pre–Commercial Demonstration", Quarterly Report, Jan. 1–Mar. 31, 1997, Document #666275, Report Nos.: DOE/MC/31176–07.

"Proceedings of the 1997 Advanced Turbine Systems", Annual Program Review Meeting, Oct. 28–29, 1997.

AXIAL THERMAL MEDIUM DELIVERY TUBES AND RETENTION PLATES FOR A GAS TURBINE ROTOR

RELATED APPLICATIONS

This application is a continuation of application Ser. No. 09/334,187, filed Jun. 16, 1999, now abandoned, the entire content of which is incorporated herein by reference.

This invention was made with Government support under Contract No. DE-FC21-95MC31176 awarded by the Department of Energy. The Government has certain rights in this invention.

TECHNICAL FIELD

The present invention relates to gas turbines having rotational components cooled by a thermal medium flowing within the rotor and particularly relates to thermal medium supply and return tubes extending parallel to the rotor axis adjacent the rim of the rotor for supplying a thermal medium to buckets carried by the turbine wheels and returning spent cooling thermal medium.

BACKGROUND OF THE INVENTION

In assignee's prior U.S. Pat. No. 5,593,274, there is disclosed a gas turbine having a closed cooling circuit for supplying a thermal medium, e.g., cooling steam, generally in an axial direction along the rotor to turbine buckets to cool the buckets and returning the spent thermal medium in an opposite, generally axial direction for flow from the rotor, for example, to the steam turbines of a combined-cycle system. In the turbine disclosed in that patent, cooling steam is supplied via an axial bore tube assembly, radially outwardly extending tubes and a plurality of axially extending tubes along the rims of the wheels and spacers for supplying steam to the buckets. Spent cooling steam returns from the buckets through passages in substantially concentric relationship with the cooling steam supply tubes for return via the bore assembly. While such arrangement has proven satisfactory, a new and improved cooling circuit has been designed in connection with a new and further advanced gas turbine.

BRIEF SUMMARY OF THE INVENTION

In accordance with a preferred embodiment of the present invention, the thermal medium, for example, steam, is supplied in an axially forward direction through an aft bore tube assembly, through a plurality of radial tubes in an aft disk, and for flow in supply tubes disposed in aligned openings through the stacked wheels and spacers comprising the rotor and adjacent the rims of the wheels and spacers. The supply tubes lie in communication with the buckets of one or more turbine wheels, preferably the first and second stage buckets, whereby bucket cooling is effected. Spent cooling steam is returned from the buckets via another set of tubes passing in an axial direction through aligned openings adjacent the rims of the wheels and spacers for flow through radially inwardly directed tubes provided in the aft disk for return along the centerline of the bore tube. It has been found highly desirable to minimize the heat lost from the thermal medium flowing through the supply and return tubes into the rotor structure. To accomplish that, the cooling steam is insulated from the rotor structure to minimize the thermal effect on the rotor resulting from the flow of cooling steam through the rotor. Particularly, the tubes are spaced from the walls of the openings to provide insulation between the tubes and the rotor wheels and spacers.

The supply and return tubes also accommodate mechanical and thermal stresses during operation. For example, when the rotor wheels and spacers are assembled, the openings through the wheels and spacers are aligned with one another co-linearly, enabling the tubes to be inserted into the passages defined by the aligned openings after rotor assembly. However, at steady-state turbine operation, the passages do not remain co-linear. Rather, the passages shift out of position relative to one another as a result of mechanical and thermal stresses. Because the masses of the wheels and spacers are different from one another and hence have different mechanical and thermal responses at steady-state, the passages at steady-state turbine operation tend to misalign with one another. Further, the thermal stresses induced by passing cooling steam through the tubes and returning even hotter spent cooling steam causes the tubes to thermally respond, tending to expand the tubes. Additionally, during steady-state operation, the rotor rotates at 3600 rpm. Because the tubes are located about the periphery of the rotor at substantial distances from the rotor axis, substantial centrifugal forces act on the tubes, causing significant stresses in the tubes. With the wheel and spacer passages somewhat misaligned because of the mechanical and thermal stresses on the rotor, the tubes must be designed to minimize any tendency to rupture, crack or become fatigued as a result of lying in a high centrifugal field. Moreover, because the tubes carry cooling steam and are oftentimes during different operational modes at different temperatures than the temperature of the rotor, thermal strain differentials will appear between the tube and rotor which, combined with the centrifugal loading and friction, cause substantial loads on the tubes. If unrestricted, such loads could result in an unpredictable shift in the axial position of the tubes. The axial location of the tubes within the rotor must be constrained within limits to facilitate the flow of steam in different directions relative to the-tubes.

To alleviate or minimize mechanical and thermal stresses on the tubes, the tubes are specifically constructed to have raised lands at axially spaced positions along the tubes separated by thin-walled tube sections. The raised lands thus have exterior surfaces at radial locations larger than the radial locations of the exterior surfaces of the thin-walled sections between the lands. The raised lands engage bushings in the passages through the rotor and, hence, the exterior surfaces of the thin-walled sections are separated by annular spaces from the interior surfaces of the passages. These annular spaces form insulation blankets minimizing the thermal effect of the cooling medium on the rotor.

Transition areas between the lands and the thin-walled sections are also provided to minimize transmission of stresses between the lands and the thin-walled sections. The transition portions include arcuate annular surfaces transitioning from the exterior surface of the lands to the radially reduced exterior surfaces of the thin-walled sections.

Additionally, because the tubes lie in a high centrifugal field during rotor rotation, the heavier the tube, the higher the load applied to tube support bushings. This increased loading on the tube supports increases friction loading as the tubes respond thermally. As the tube responds to the thermal load, the tube grows axially, increasing frictional loading at each support location. The friction load decreases, however, in a direction away from a support which fixes the axial location of the tube in the rotor. By varying the thickness along the tube in accordance with a preferred embodiment of the present invention, and in a direction away from a fixed support for the tube, the load accumulation decreases. Consequently, the thin-walled sections, which are dead weight, can be made progressively thinner in a direction away from the fixed support. That is, the thinner the thin-walled section, the less weight a given support carries and, accordingly, the friction load carried by the tubes decreases as the tube thermally grows. In a preferred form of the invention, the tube is axially fixed adjacent an aft end thereof so that axial tube growth occurs in an axial forward direction. Consequently, the thin-walled sections are increasingly thinner in a direction away from the fixed support, e.g., thinner in an axially forward direction from an aft fixed tube support.

In accordance with another preferred aspect of the present invention, axial retention assemblies are provided on the rotor, preferably on the aft rotor wheel to fix the supply and return tubes at that location, enabling axial thermal growth in an axially forward direction. Each retention assembly, in accordance with a preferred embodiment hereof, includes, for each tube, a pair of retention plates disposed in an annular recess along an annular face of the last wheel of the rotor, e.g., the aft face of the fourth stage wheel in a four-stage turbine. The retention plates are preferably disposed between opposed radial flanges and have arcuate sections straddling the tube extending through the passages and into the annular recess. The tube includes a shoulder against which the retention plate bears to restrain the tube from movement under thermal loading in an axially aft direction. The tube also includes a shoulder for bearing against a portion of the wheel to preclude movement of the tube in an axially forward direction. Slots are preferably formed adjacent the retention plates in the outer flange to facilitate assembly and removal of the retention plates. The retention plates are held in position straddling the tubes by pins engaging in the wheel. Upon removal of the pins, the retention plates can be displaced in a circumferential direction to register radially with slots in the outer flange, enabling the retention plates to be removed from the rotor.

In a preferred embodiment according to the present invention, there is provided multi-stage rotor for a gas turbine, the rotor having an axis, comprising a plurality of turbine wheels and spacers disposed alternately relative to one another along the rotor axis and secured generally in axial alignment with one another, a plurality of axially aligned, circumferentially spaced, openings through the wheels and spacers at locations spaced radially from the axis and tubes disposed in the openings for flowing a thermal medium, the tubes having raised lands at axially spaced locations therealong for mounting the tubes in the passages, the lands having a predetermined wall thickness, the tubes including thin-walled tube sections between the lands of a thickness less than the predetermined thickness and with exterior wall surfaces thereof at radii less than radii of exterior wall surfaces of the lands.

In a further preferred embodiment according to the present invention, there is provided a multi-stage rotor for a turbine, the rotor having an axis, comprising a plurality of turbine wheels and spacers disposed alternately relative to one another along the rotor axis and secured generally in axial alignment with one another, a plurality of axially aligned, circumferentially spaced, openings through the wheels and spacers at locations spaced radially from the axis, tubes disposed in the openings for flowing a thermal medium and a retention plate carried by the rotor for fixing each tube to the rotor against axial displacement in one axial direction and located at a predetermined axial position along the tube, each tube including a shoulder for engaging the plate to preclude displacement of the tube in the one axial direction.

DETAILED DESCRIPTION OF THE INVENTION

Figure 1:
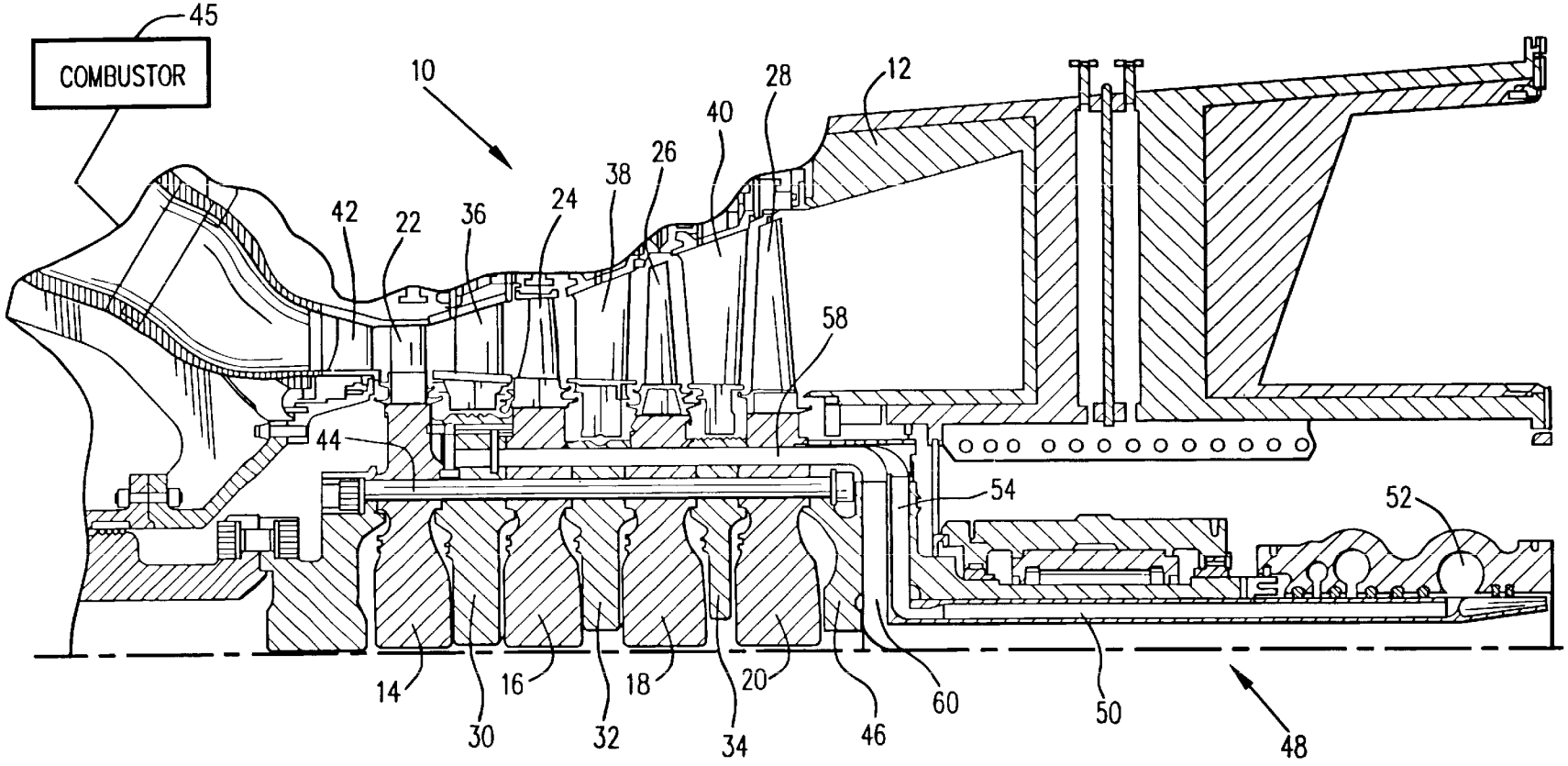
FIG. 1 is a cross-sectional view of a portion of a gas turbine illustrating a turbine section.

Referring to FIG. 1, there is illustrated a turbine section, generally designated 10, incorporating the present invention. The turbine section 10 includes a turbine housing 12 surrounding a turbine rotor R. Rotor R includes in the present example four successive stages comprising wheels 14, 16, 18 and 20, carrying a plurality of circumferentially spaced buckets or blades 22, 24, 26 and 28, respectively. The wheels are arranged alternately between spacers 30, 32 and 34. The outer rims of spacers 30, 32 and 34 lie in radial registration with a plurality of stator blades or nozzles 36, 38 and 40, with the first set of nozzles 42 lying forwardly of the first buckets 22. Consequently, it will be appreciated that a four-stage turbine is illustrated wherein the first stage comprises nozzles 42 and buckets 22; the second stage, nozzles 36 and buckets 24; the third stage, nozzles 38 and buckets 26 and, finally, the fourth stage, nozzles 40 and buckets 28. The rotor wheels and spacers are secured one to the other by a plurality of circumferentially spaced bolts 44 passing through aligned openings in the wheels and spacers. A plurality of combustors, one being illustrated at 45, are arranged about the turbine section to provide hot gases of combustion through the hot gas path of the turbine section in which the nozzles and buckets for rotating the rotor are disposed. The rotor also includes an aft disk 46 formed integrally with a bore tube assembly, generally designated 48.

Figure 2:
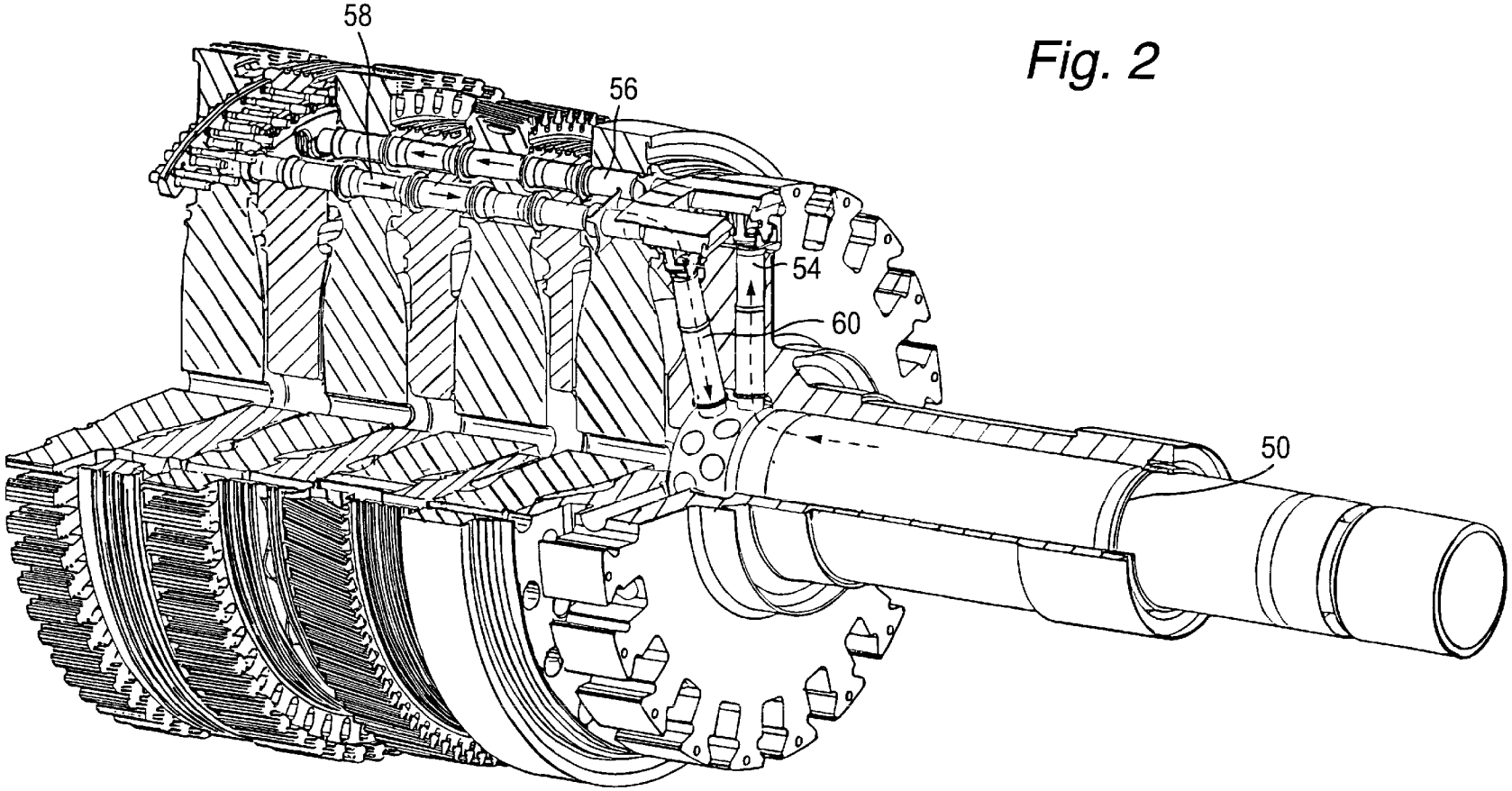
FIG. 2 is a fragmentary perspective view of portions of a turbine rotor with parts broken out and in cross-section for ease of illustration.

At least one and preferably both sets of buckets 22 and 24 of the first two stages are provided with a thermal medium for cooling, the thermal medium preferably being cooling steam. Cooling steam is provided and returned through the bore tube assembly 48. With reference to FIGS. 1 and 2 and in a preferred embodiment, the bore tube assembly includes an annular passage 50 supplied with cooling steam, from a steam plenum 52 for flow to a plurality of radially extending tubes 54 provided in the aft disk 46. Tubes 54 communicate with circumferentially spaced, axially extending thermal medium supply tubes 56 in communication with cooling passages in the first and second-stage buckets. Spent or returned cooling steam at an elevated temperature flows from the first and second-stage buckets through a plurality of circumferentially spaced, axially extending return tubes 58. Return tubes 58 communicate at their aft ends with radially inwardly extending return tubes 60 in aft disk 46. From tubes 60, the spent steam flows into the central bore of the bore tube assembly 48 for return to a supply or for flow to steam turbines for use in a combined-cycle system.

Figure 3A:
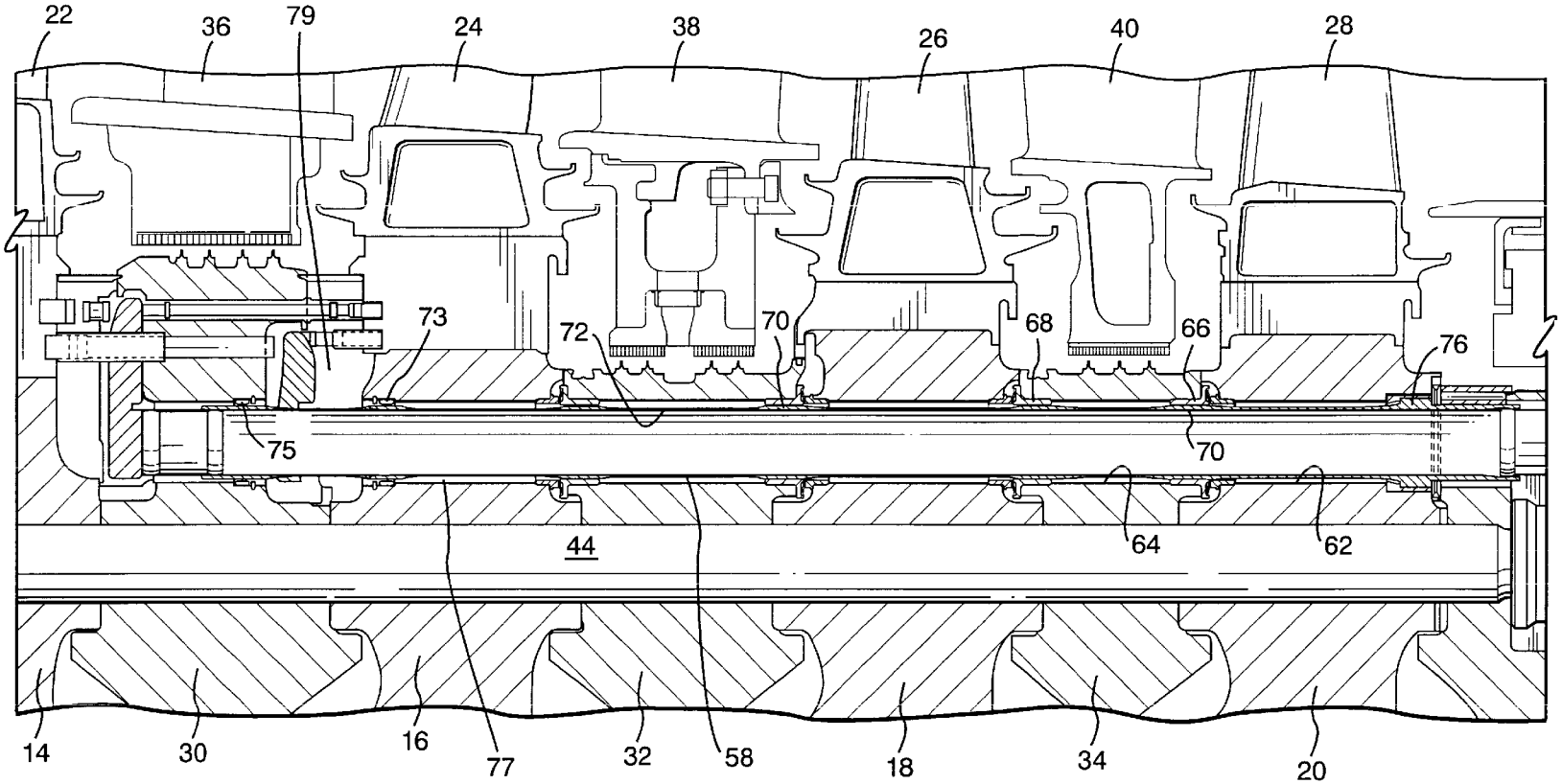
FIG. 3A is a fragmentary enlarged cross-sectional view illustrating, in cross-section, a rim of the rotor with the thermal medium return tube being illustrated.
Figure 3B:
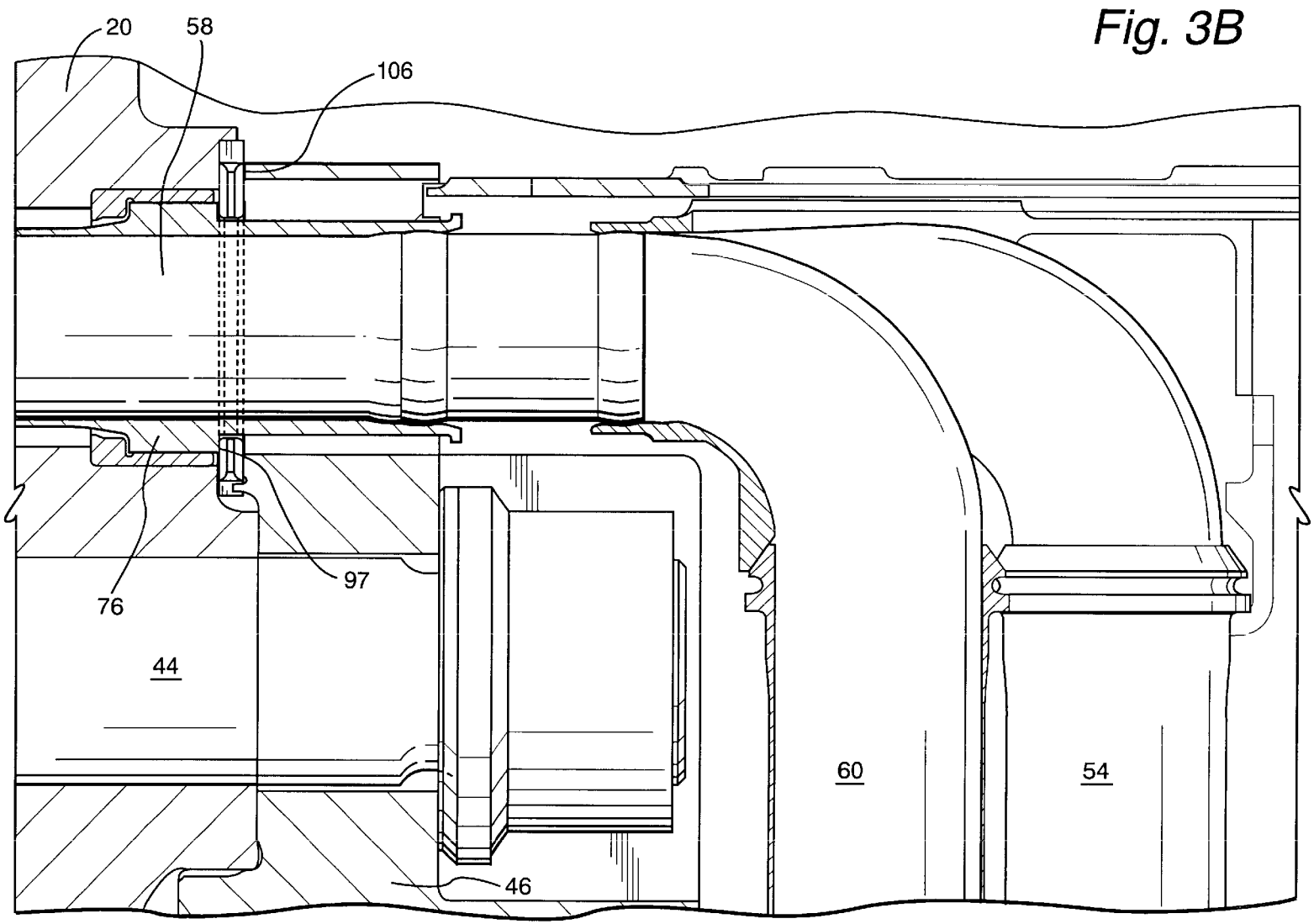
FIG. 3B is an enlarged cross-sectional view of an aft portion of the rotor adjacent its rim illustrating the location of retention plates for a thermal medium return tube according to the present invention.

It will be appreciated from the foregoing description that the axially extending supply and return tubes 56 and 58, respectively, lie adjacent the rim of the rotor, with each supply and return tube extending through axially aligned openings through the axially stacked wheels and spacers. For example, the aligned openings 62 and 64 of wheels 20 and spacers 34, respectively, are illustrated in FIG. 3A. Similar aligned openings are provided in the wheels and spacers of the first, second and third stages.

As illustrated in FIG. 3A, bushings are provided at various locations within the openings of the wheels and spacers for supporting the cooling medium supply and return tubes 56 and 58, respectively. For example, bushings 66 and 68 are disposed adjacent opposite ends of the opening 64 through spacer 34. Similar bushings are disposed at opposite ends of the third-stage spacer 32. Bushings 73 and 75 are provided at the forward opening of wheel 16 and the aft opening of spacer 30. Similar bushings are provided in the aligned openings for the supply tube.

Figure 4:
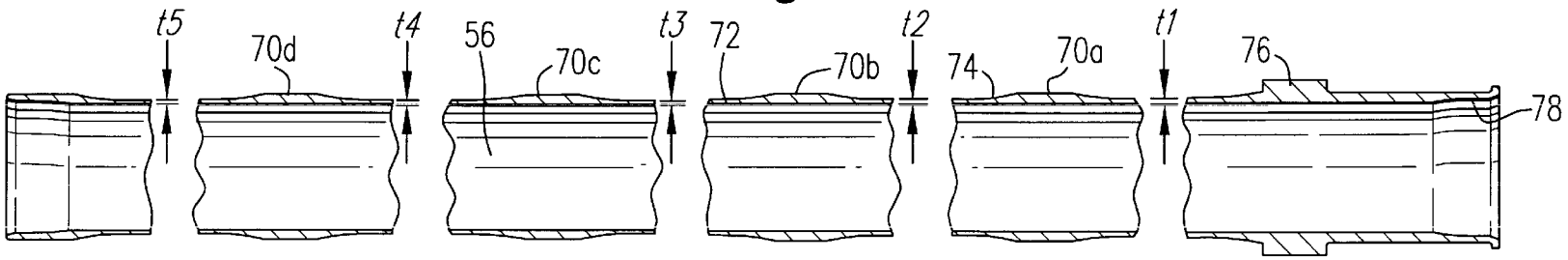
FIGS. 4 and 5 are fragmentary cross-sectional views of the thermal medium supply and return tubes, respectively, with portions broken out for ease of illustration.
Figure 5:
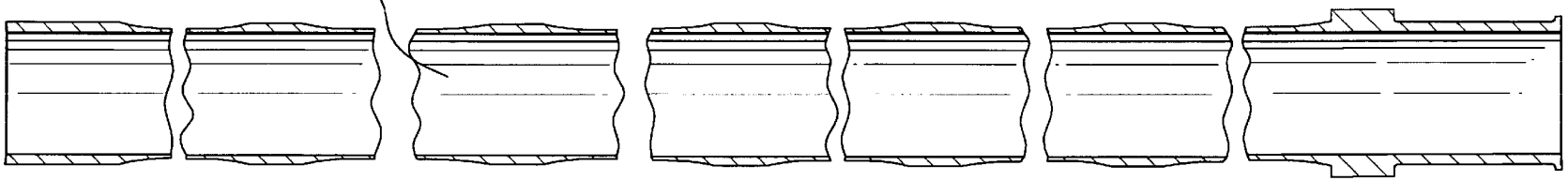

Referring to FIGS. 4 and 5, the respective supply and return tubes 56 and 58 are illustrated. The tubes are similar in aspects relevant to this invention and a description of one will suffice as a description of the other, except as otherwise noted. Each tube comprises a thin-walled structure having a plurality of raised lands 70 at axially spaced locations along the length of the tube. The axial locations of the lands 70 coincide with the locations of the bushings in the openings through the wheels and spacers. Between the lands 70 are thin-walled tube sections 72 (FIG. 3A). From a review of FIGS. 4 and 5, it will be appreciated that the outer exterior surfaces of the lands 70 are radially outwardly of the exterior surface of the thin-walled sections 72. Transition sections 74 are provided between each land 70 and adjacent thin-walled sections 72. The transition sections 74 have arcuate outer surfaces transitioning radially inwardly from the outer surface of the lands to the outer surfaces of the thin-walled sections 72. These transition areas 74 smooth the stresses from the raised lands to the thin sections. An enlarged land or flange 76 is provided adjacent an aft portion of each tube, for reasons explained below. As illustrated in FIG. 4, the interior end portions of the supply tubes 56 have concave surfaces 78 for mating engagement with convex surfaces of spoolies for flowing the thermal medium into and out of the return tubes.

It will be appreciated that the thin-walled sections are not supported between the lands and that, in the high centrifugal field during rotor rotation, the heavier the tube, the greater will be the friction forces carried by the tubes at the support points between the lands and the bushings. As the tubes are subjected to thermal or mechanical stresses, the higher the loading at the supports, the higher the friction load as the tube thermally grows in an axial direction from its fixed aft end. As a result of fixing the aft end of the tubes, the friction load developed at each support point creates a loading which is cumulative from forward to aft. That is, actual tube loading from thermal growth increases in the aft direction. By varying the thicknesses along the tube and particularly increasing the thicknesses of the tube in the aft direction, the higher frictional loads forwardly of each support can be accommodated. Stated differently, the thinner each thin-walled section becomes in the forward axial direction, the less weight a given support carries and, consequently, a smaller friction load is generated under thermal growth conditions. Because the tubes are fixed at their aft ends, the thermal growth moves axially forwardly. At each support location, the accumulating frictional loading is the loading at that location with the added loading of locations axially forwardly of the given location.

Particularly, the thicknesses t1-t5 of the thin-walled sections 72 between the lands 70 decrease in thickness from the aft end of the tubes 56 and 58 to their forward ends. That is, the wall thickness t1 of the thin-walled section 72 between axially spaced flange 76 and land 70*a* is thicker than the wall thickness t2 between axially adjacent lands 70*a* and 70*b*. Similarly, the wall thickness t2 is greater than the wall thickness t3 of the thin-walled section 72 between axially adjacent lands 70*b* and 70*c*. The wall thickness t3 is greater than the wall thickness t4 between lands 70*c* and 70*d*. The wall thickness t4 is greater than the wall thickness t5 between axially adjacent lands 70*d* and the forward end of the tube. Thus, the wall thicknesses of the thin-walled sections 72 decrease from the aft ends of the tubes toward the forward ends of the tubes.

Because the interior wall surfaces of the tubes have smooth bores, the progressive decrease in wall thickness of the thin-walled sections toward the forward end of the rotor results in decreasing outside diameters of the thin-walled sections. This, in turn, results in an increase in the thickness of thermal insulation cavities 77 between the tubes and the openings through the wheels and spacers receiving the tubes and enhanced thermal insulation between the tubes and the rotor.

The insulation cavities 77 between the tubes and aligned openings of the wheels and spacers form essentially dead air spaces for thermally insulating the cooling medium carried by the tubes from the rotor. While the clearances between the bushings and the tubes are relatively small, e.g., about 17 mils, the clearance between the bushings 73 and the lands of the supply and return tubes at that axial location are tighter, e.g., 10 mil clearances. By reducing the clearance between the bushings at the forward face of wheel 16 and the tube lands at that axial location, air flow from the cavity 79 along the tubes in an aft direction is discouraged thereby maintaining essentially stagnant air in the cavities 77 between the tubes and the aligned openings of the wheels and spacers.

Figure 6:
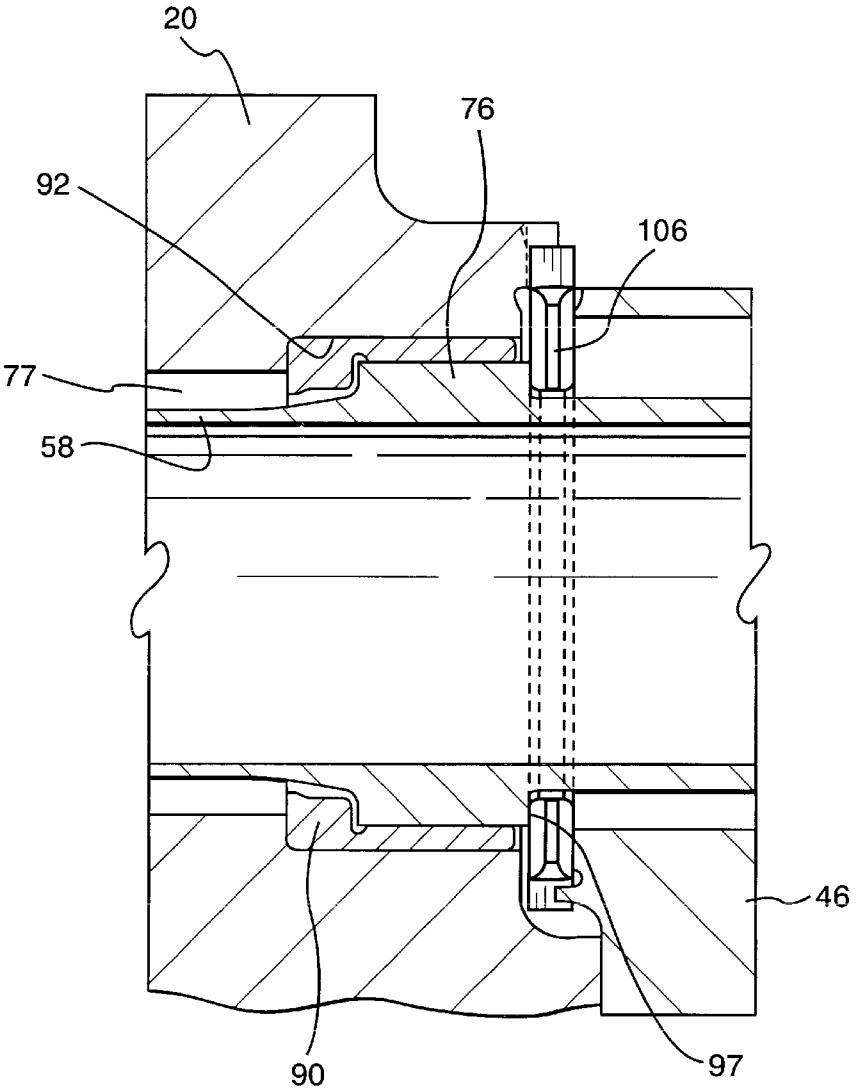
FIG. 6 is an enlarged fragmentary cross-sectional view illustrating a retention plate for one of the tubes in position on the aft face of the aft wheel.

Referring now to FIGS. 6–10, retention assemblies are illustrated in accordance with a preferred embodiment of the present invention for fixing the aft ends of the supply and return tubes 56 and 58 to the rotor. In FIG. 6, a tube, for example, a return tube 58, is illustrated with the radially enlarged land 76. Also illustrated is the bushing 90 disposed in a counterbored recess 92 in the aft face of the fourth wheel 20. The forward edge of the raised land 76 of tube 58 bears against an interior flange of the bushing 90 to prevent forward axial movement of the tube. The rear shoulder 97 of each land 76 bears against a pair of retention places 106, precluding movement in a rearward direction. The retention plates 106 in turn bear against a forward face of the aft disk 46.

Figure 8:
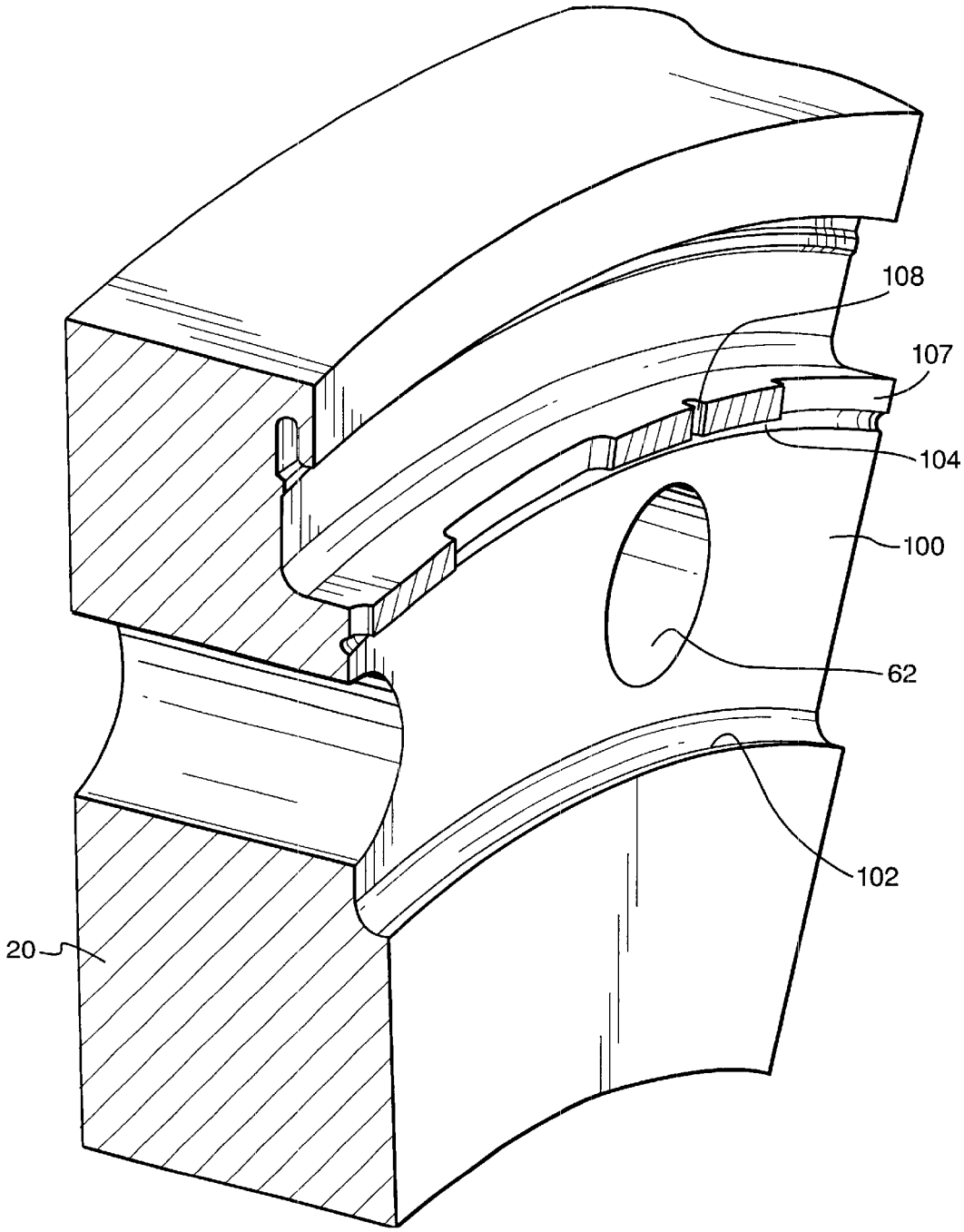
FIG. 8 is a fragmentary perspective view with parts in cross-section illustrating the aft face of the aft wheel.

Referring to FIG. 8, the aft wheel face includes an annular recess 100 through which pass the openings 62 for receiving the tubes. The recess 100 is bounded radially by flanges 102 and 104 which form radial inner and outer stops, respectively, for retention plates 106. The radial outer flange 104 includes a plurality of circumferentially spaced indents or slots 107 which afford access openings for removal of the retention plates 106 as described below. A reduced access slot 108 is formed in the flange 104 at circumferentially spaced positions about the aft face of the wheel at each tube opening location, affording an access slot to the retention plate whereby the plate can be shifted to a position for removal in a manner which will now be described.

Figure 7:
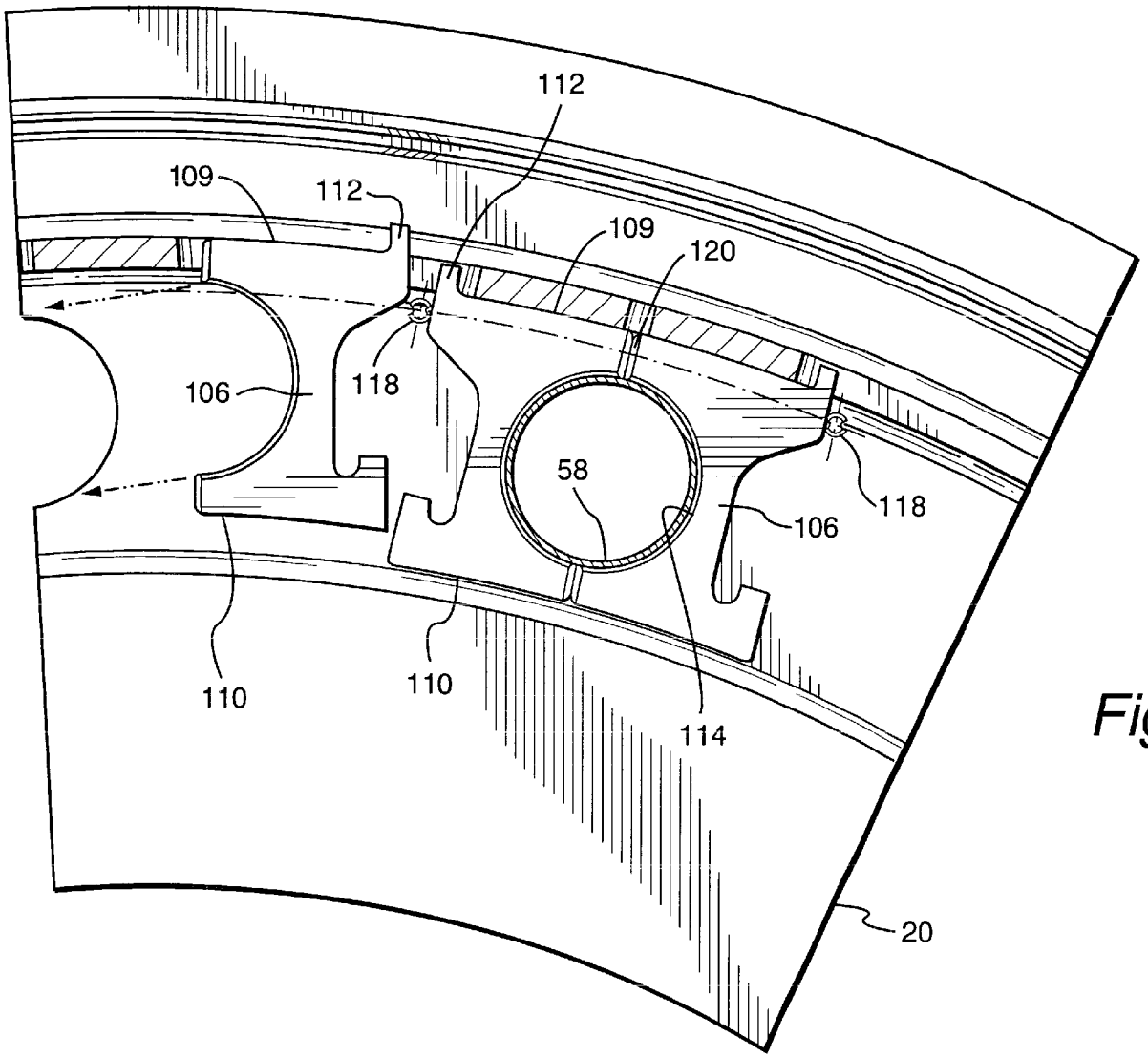
FIG. 7 is an enlarged fragmentary elevational view of the aft face of the aft wheel illustrating the retention plates in position about a tube and a single retention plate in position for removal.
Figure 10:
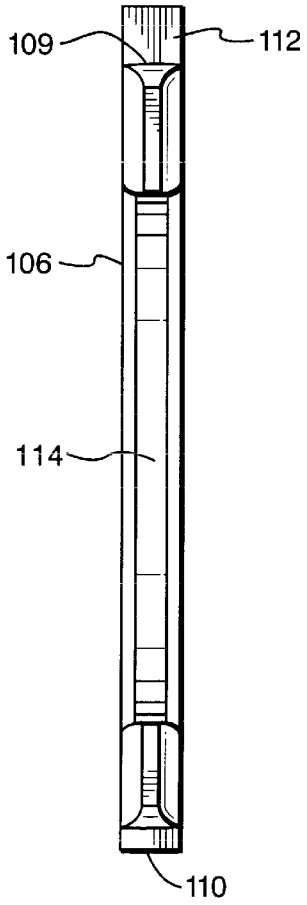
FIGS. 9 and 10 are side and end elevational views of a preferred retention plate.
Figure 9:
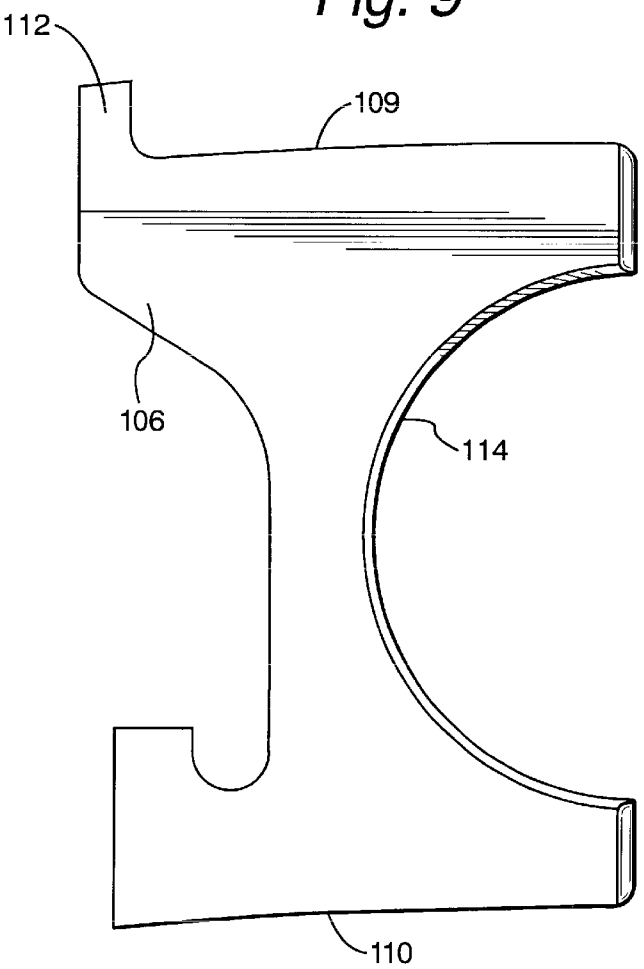

Referring to FIGS. 9 and 10, there is illustrated a retention plate 106 which forms one-half of a retention assembly for each tube, i.e., two retention plates are employed to retain each axial tube fixed at an aft end portion of the tube. Each retention plate 106 includes curved outer and inner edges 109 and 110, respectively, corresponding to the curvature of respective flanges 104 and 102 so that the plates can be received between the flanges. An ear 112 projects outwardly from the radially outer edge 109 of the retention plate and projects into one end of the access slot 107 of the outer flange 104. The retention plates of each retention assembly are mirror images of one another. The inside edge of each plate 106 has a semi-circular edge 114 corresponding in radius to the radius of the tube. Consequently, as seen in FIG. 7, the retention plates 106 are located between flanges 104 and 102 and straddle circumferentially opposite sides of the tube 58. In order to lock the retention plates 106 in position behind the raised land 76, a pair of pins, i.e., stops 118 are inserted into openings in the face of the aft wheel and engage the circumferential outer edges of the retention plates 106 to prevent circumferential separating movement of the plates 106 from their position straddling the tube. Access to the pins 118 for their removal and removal of the retention plates is obtained after removal of overlying windage plates. The pins 118 are then withdrawn rearwardly from the aft shaft 46. Upon removal of the pins 118 by inserting a suitable tool through slot 107, each retention plate can slide in a circumferential direction away from its retained tube for radial alignment with the slot 107 through the radially outermost flange 104. A wedging tool may be disposed through the slot 108 to engage the chamfered surfaces 120 of the retention plates to initially separate the plates, if necessary. Otherwise, the ears 112 can be engaged by a suitable tool to displace the plates 106 into registration with slots 107 for removal.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A multi-stage rotor for a gas turbine, the rotor having an axis, comprising:

a plurality of turbine wheels and spacers disposed alternately relative to one another along the rotor axis and secured generally in axial alignment with one another;

a plurality of axially aligned, circumferentially spaced, openings through the wheels and spacers at locations spaced radially from said axis; and tubes disposed in said openings for flowing a thermal medium, said tubes having raised cylindrical lands at axially spaced locations therealong for mounting the tubes in said openings, said lands having a predetermined wall thickness, said tubes including thin-walled tube sections between said lands of a thickness less than said predetermined thickness and with exterior wall surfaces thereof at radii less than radii of exterior wall surfaces of said lands.

2. A rotor according to claim 1 including arcuate transition areas along said tubes between said raised lands and said thin-walled sections.

3. A rotor according to claim 1 wherein said openings and said thin-walled sections lie spaced one from another forming an annular space therebetween.

4. A multi-stage rotor for a turbine, the rotor having an axis, comprising:

a plurality of turbine wheels and spacers disposed alternately relative to one another along the rotor axis and secured generally in axial alignment with one another;

a plurality of axially aligned, circumferentially spaced, openings through the wheels and spacers at locations spaced radially from said axis;

tubes disposed in said openings for flowing a thermal medium; and a retention plate carried by said rotor for fixing each tube to said rotor against axial displacement in one axial direction and located at a predetermined axial position along said tube, each tube including a shoulder for engaging said plate to preclude displacement of said tube in said one axial direction.

5. A rotor according to claim 4 wherein one of said wheels and said spacers includes an annular face about said axis, said openings opening through said face, radially opposite stops engaging said retention plates along radially opposite margins of said plates to preclude displacement of said plates in radial directions and stops spaced circumferentially from said tubes and engaging said retention plates to preclude movement of said plates in at least one circumferential direction about said face.

6. A rotor according to claim 4 wherein one of said wheels and said spacers includes an annular face about said axis, said openings opening through said face, radially opposite stops engaging said retention plates along radially opposite margins of said plates to preclude displacement of said plates in radial directions, said radially opposite stops comprising flanges projecting axially from an axial face of said one wheel and spacer, a radially outermost flange of said opposite stops being interrupted to define circumferentially spaced slots, said retention plates being movable in circumferential directions along said flanges for registration with said slots thereby enabling said retention plates for removal from said one wheel and spacer in radial outward directions through said slots.

7. A rotor according to claim 4 including pairs of retention plates carried by said rotor, each pair of retention plates disposed at a predetermined axial position along a tube for fixing said tube against axial displacement in one axial direction, each said pair of plates straddling said tube along opposite sides thereof, each tube including a shoulder for engaging said pair of plates to preclude displacement of said tubes in said one axial direction.

8. A rotor according to claim 7 wherein one of said wheels and said spacers includes an annular recess about said axis defined in part by radially spaced circumferentially extending flanges, said openings opening into said recess with said tubes passing through said recess in an axial direction, said retention plates lying in said recess with said flanges engaging radially opposite margins of said plates to preclude displacement of said plates in radial directions, the radially outermost flange of said radially spaced flanges being interrupted to define circumferentially spaced slots therebetween, said retention plates being movable in circumferential directions along said recess for radial registration with said slots thereby enabling said retention plates for removal from said one wheel and spacer in radial outward directions through said slots.

9. A multi-stage rotor for a gas turbine, the rotor having an axis, comprising:

a plurality of turbine wheels and spacers disposed alternately relative to one another along the rotor axis and secured generally in axial alignment with one another;

a plurality of axially aligned, circumferentially spaced, openings through the wheels and spacers at locations spaced radially from said axis;

tubes disposed in said openings for flowing a thermal medium, said tubes having raised lands at axially spaced locations therealong for mounting the tubes in said openings, said lands having a predetermined wall thickness, said tubes including thin-walled tube sections between said lands of a thickness less than said predetermined thickness and with exterior wall surfaces thereof at radii less than radii of exterior wall surfaces of said lands; and retention plates carried by said rotor for fixing said tubes to said rotor against axial displacement in one axial direction, each tube including a shoulder for engaging said plate to preclude displacement of said tube in said one axial direction.

10. A rotor according to claim 9 wherein one of said wheels and said spacers includes an annular face about said axis, said openings opening through said face, radially opposite stops engaging said retention plates along radially opposite margins of said plates to preclude displacement of said plate in radial directions and a stop spaced circumferentially from said tube and engaging said retention plate to preclude movement of said plate in at least one circumferential direction about said face.

11. A rotor according to claim 9 wherein one of said wheels and said spacers includes an annular face about said axis, said openings opening through said face, radially opposite stops engaging said retention plates along radially opposite margins of said plates to preclude displacement of said plates in radial directions, said radially opposite stops comprising flanges projecting axially from an axial face of said one wheel and spacer, a radially outermost flange of said opposite stops being interrupted to define a plurality of slots, each said retention plate being movable in a circumferential direction along said flanges for registration with a respective slot thereby enabling said retention plate for removal from said one wheel and spacer in a radial outward direction through said slot.

12. A multi-stage rotor for a gas turbine, the rotor having an axis, comprising:

a plurality of turbine wheels and spacers disposed alternately relative to one another along the rotor axis and secured generally in axial alignment with one another;

a plurality of axially aligned, circumferentially spaced, openings through the wheels and spacers at locations spaced radially from said axis;

tubes disposed in said openings for flowing a thermal medium, said tubes having raised lands at axially spaced locations therealong for mounting the tubes in said openings, said lands having a predetermined wall thickness, said tubes including thin-walled tube sections between said lands of a thickness less than said predetermined thickness and with exterior wall surfaces thereof at radii less than radii of exterior wall surfaces of said lands; and pairs of retention plates carried by said rotor, each pair of retention plates disposed at a predetermined axial position along a tube for fixing said tube against axial displacement in one axial direction, each said pair of plates straddling said tube along opposite sides thereof, each tube including a shoulder for engaging said pair of plates to preclude displacement of said tubes in said one axial direction.

13. A rotor according to claim 12 wherein one of said wheels and said spacers includes an annular recess about said axis defined in part by radially spaced, circumferentially extending flanges, said openings opening into said recess with said tubes passing through said recess in an axial direction, said retention plates lying in said recess with said flanges engaging radially opposite margins of said plates to preclude displacement of said plates in radial directions, the radially outermost flange of said radially spaced flanges being interrupted to define circumferentially spaced slots, said retention plates being movable in circumferential directions along said recess for radial registration with said slots thereby enabling said retention plates for removal from said one wheel and spacer in radial outward directions through said slots.

14. A multi-stage rotor for a gas turbine, the rotor having an axis, comprising:

a plurality of turbine wheels and spacers disposed alternately relative to one another along the rotor axis and secured generally in axial alignment with one another;

a plurality of axially aligned, circumferentially spaced, openings through the wheels and spacers at locations spaced radially from said axis;

tubes disposed in said openings for flowing a thermal medium, said tubes having raised lands at axially spaced locations therealong for mounting the tubes in said openings, said lands having a predetermined wall thickness, said tubes including thin-walled tube sections between said lands of a thickness less than said predetermined thickness and with exterior wall surfaces thereof at radii less than radii of exterior wall surfaces of said lands; and the thickness of at least certain of said thin-walled sections of each tube being different than the thickness of other thin-walled sections of said tube.

15. A multi-stage rotor for a gas turbine, the rotor having an axis, comprising:

a plurality of turbine wheels and spacers disposed alternately relative to one another along the rotor axis and secured generally in axial alignment with one another;

a plurality of axially aligned, circumferentially spaced, openings through the wheels and spacers at locations spaced radially from said axis;

tubes disposed in said openings for flowing a thermal medium, said tubes having raised lands at axially spaced locations therealong for mounting the tubes in said openings, said lands having a predetermined wall thickness, said tubes including thin-walled tube sections between said lands of a thickness less than said predetermined thickness and with exterior wall surfaces thereof at radii less than radii of exterior wall surfaces of said lands; and the thickness of succeeding thin-walled sections of each tube in a first axial direction along said tube being less than the thickness of axially preceding thin-walled sections.

16. A multi-stage rotor for a gas turbine, the rotor having an axis, comprising:

a plurality of turbine wheels and spacers disposed alternately relative to one another along the rotor axis and secured generally in axial alignment with one another;

a plurality of axially aligned, circumferentially spaced, openings through the wheels and spacers at locations spaced radially from said axis;

tubes disposed in said openings for flowing a thermal medium, said tubes having raised lands at axially spaced locations therealong for mounting the tubes in said openings, said lands having a predetermined wall thickness, said tubes including thin-walled tube sections between said lands of a thickness less than said predetermined thickness and with exterior wall surfaces thereof at radii less than radii of exterior wall surfaces of said lands; and the thickness of each next adjacent thin-walled section of each tube in a first axial direction along said tube being less than the thickness of each next axially preceding thin-walled section.

17. A multi-stage rotor for a gas turbine, the rotor having an axis, comprising:

a plurality of turbine wheels and spacers disposed alternately relative to one another along the rotor axis and secured generally in axial alignment with one another;

a plurality of axially aligned, circumferentially spaced, openings through the wheels and spacers at locations spaced radially from said axis;

tubes disposed in said openings for flowing a thermal medium, said tubes having raised lands at axially spaced locations therealong for mounting the tubes in said openings, said lands having a predetermined wall thickness, said tubes including thin-walled tube sections between said lands of a thickness less than said predetermined thickness and with exterior wall surfaces thereof at radii less than radii of exterior wall surfaces of said lands; and the thickness of succeeding thin-walled sections of each tube in a first axial direction along said tube being less than the thickness of axially preceding thin-walled sections, said tubes being fixed to said rotor adjacent one end thereof, said tubes being expandable in said first axial direction responsive to flow of the thermal medium through said tubes.

18. A multi-stage rotor for a gas turbine, the rotor having an axis, comprising:

a plurality of turbine wheels and spacers disposed alternately relative to one another along the rotor axis and secured generally in axial alignment with one another;

a plurality of axially aligned, circumferentially spaced, openings through the wheels and spacers at locations spaced radially from said axis;

tubes disposed in said openings for flowing a thermal medium, said tubes having raised lands at axially spaced locations therealong for mounting the tubes in said openings, said lands having a predetermined wall thickness, said tubes including thin-walled tube sections between said lands of a thickness less than said predetermined thickness and with exterior wall surfaces thereof at radii less than radii of exterior wall surfaces of said lands; and said wheels including bushings in said openings, certain of said lands and certain of said bushings having first clearances therebetween, another of said lands and another of said bushings at corresponding axial locations along said tubes having a second clearance therebetween less than said first clearance to discourage flow of air between said another land and said another bushing and along said tube.

* * * * *